United States Patent [19]

Davis et al.

[11] Patent Number: 4,603,749

[45] Date of Patent: Aug. 5, 1986

[54] APPARATUS FOR DOWNWARD DISPLACEMENT OF AN INNER TUBE WITHIN A CORING BARREL

[75] Inventors: J. Stanley Davis, Sandy; Steven R. Radford, West Jordan, both of Utah

[73] Assignee: Norton Christensen, Inc., Salt Lake City, Utah

[21] Appl. No.: 644,855

[22] Filed: Aug. 27, 1984

[51] Int. Cl.[4] ..... E21B 10/60; E21B 10/64

[52] U.S. Cl. ..... 175/250; 175/268

[58] Field of Search ..... 175/244, 245, 246, 250, 175/253, 257, 268, 309; 166/318

[56] References Cited

U.S. PATENT DOCUMENTS

| | | | |
|---|---|---|---|
| 366,913 | 7/1887 | Ball | 175/268 X |
| 650,686 | 5/1900 | Leask | 175/268 X |
| 1,643,338 | 9/1927 | Halvorsen | 175/244 |
| 2,038,791 | 4/1936 | Howard et al. | 175/268 X |
| 2,038,793 | 4/1936 | Howard et al. | 175/268 X |
| 2,221,392 | 11/1940 | Baker | 175/268 |
| 3,339,647 | 9/1967 | Kammerer, Jr. | 175/268 |
| 3,554,305 | 1/1971 | Kammerer, Jr. | 175/268 |

*Primary Examiner*—Stuart S. Levy

*Assistant Examiner*—Thomas R. Hannon

*Attorney, Agent, or Firm*—Beehler, Pavitt, Siegemund, Jagger & Martella

[57] ABSTRACT

Downward displacement of an inner tube with respect to the outer tube in a coring tool is effectuated by an apparatus comprising a bearing assembly, a cylinder, a piston telescopically disposed within the cylinder, and a mechanism for selectively applying an hydraulic force to the piston. The bearing assembly is longitudinally fixed with respect to the outer tube while providing rotational freedom with respect to the outer tube. A cylinder is axially disposed within the coring tool, is connected to the bearing assembly, and hence is rotationally free with respect to the outer tube. The piston, which is telescopically disposed within a cylinder, is downwardly longitudinally displaceable within the cylinder, and hence with respect to the outer tube. A mechanism is incorporated within the coring tool for selectively applying a hydraulic force to the piston in order to longitudinally displace the piston downwardly within the cylinder. The inner tube, being coupled to the piston, is thus downwardly displaced within the coring tool.

6 Claims, 3 Drawing Figures

APPARATUS FOR DOWNWARD DISPLACEMENT OF AN INNER TUBE WITHIN A CORING BARREL

BACKGROUND OF THE INVENTION

1. Field of the Invention

The present invention relates to the field of earth boring tools, and more particularly, to the coring tools and core catchers used within such coring tools.

2. Description of the Prior Art

Typically a coring tool includes a coring bit attached to a bit shoe in turn to a core barrel or outer tube, and then to a drill collar and ultimately to the drill string. Within the outer tube is at least one inner barrel designed for receiving the core cut from the rock formation. After the core is cut and extends into the inner barrel of the coring tool, it may remain integrally connected to the rock formation in the case of a consolidated rock formation or in the case of a loose or unconsolidated rock formation, would tend to fall out of the inner barrel as the drill string is tripped or otherwise retrieved.

Thus, the prior art has devised a number of different types of core catchers for breaking off the core and/or retaining the core within the inner barrel.

In the case of consolidated formations, such core catchers usually comprise a plurality of wedge shaped segments collectively forming a ring at the lower end of the inner barrel near the inner gage of the bit. The wedge segments contact the core and have a diametrical interference fit. In other words, as the inner barrel or drill string moves upwardly the frictional contact between the core catcher segments and the core cause the wedge shaped segments to jam between a longitudinally inclined surface provided within the coring tool and the otherwise substantially longitudinally cylindrical outer surface of the core. The core is thus broken from the rock formation and wedged tightly in the inner barrel for retrieval.

In the case of an unconsolidated or loose formation, such a diametrical interference between a core catcher and the core, may not result in the secure retention of the core within the barrel. Therefore, the prior art has devised full closure core catchers which include a plurality of flapper valves which form a cusped one way valve which fully or at least partially closes the inner annular space of the inner barrel. Again, such flapper valves are generally spring biased inwardly into the interior of the inner barrel. As the core enters the inner barrel, these flapper valves permit relative longitudinal upward movement of the core. However, as soon as the inner barrel or drill string is longitudinally pulled upwardly with respect to the core, the flapper valves dig in or otherwise rotate inwardly by virtue of the weight or frictional contact with the core to effect a full or partial closure. As the flapper valves rotate inwardly, they meet with each other tending to effect a full closure, and also jam against each other to operate as a one-way valve mechanism.

In each case, actuation of such core catchers relies upon frictional contact, diametral interference, or the longitudinal and/or gravitational force on the core in order to operate. In addition, because of the reliance upon the use of frictional contact and force exerted between the core catcher and core, the core tends to be disturbed, altered or otherwise disarranged.

Therefore, what is needed is an apparatus for operating a core catcher or other downhole tool which overcomes each of these prior art defects.

BRIEF SUMMARY OF THE INVENTION

The present invention is an apparatus for use in an earth boring tool for providing a downward longitudinal displacement within the tool. The apparatus comprises a first mechanism defining the cylinder. A second mechanism defines a piston disposed within the cylinder, the cylinder is longitudinally fixed with respect to the tool, and the piston is selectively longitudinally displaceable with respect to the tool. A third mechanism selectively locks the piston to the cylinder. A fourth mechanism in turn selectively applies hydraulic force to the piston, and unlocks the piston cylinder to allow the piston to be driven longitudinally downward. By reason of this combination of elements, an apparatus is provided for generating and applying a longitudinal downward force in movement within an earth boring tool.

More particularly, the present invention is an apparatus in a coring tool for effecting relative longitudinal displacement of an inner barrel within the coring tool with respect to an outer tube of the coring tool. The apparatus comprises a bearing assembly which is longitudinally fixed with respect to the outer tube, and is rotationally free with respect to the outer tube. A cylinder is axially disposed within the coring tool, and is connected to the bearing assembly. The cylinder is rotationally free with respect to the outer tube. A piston is telescopically disposed within the cylinder and longitudinally displaceable with respect to it. A mechanism is included which selectively applies a hydraulic force to the piston to longitudinally displace the piston with respect to the cylinder. The inner tube is coupled to the piston, and is therefore longitudinally displaced according to the displacement of the piston. Again, by combination of these elements an inner tube is selectively longitudinally and downwardly displaced within a coring tool with respect to the outer tube.

These and other embodiments and details of the invention can best be understood by first briefly turning to the following drawings wherein like elements are referenced by like numerals.

The invention and its various embodiments may be better understood by now turning to the following detailed description.

DETAILED DESCRIPTION OF THE PREFERRED EMBODIMENTS

The present invention is an actuating means for positively forcing an inner barrel downwardly within a coring tool. The actuating force may be used for any purpose and, in particular, for positively actuatiang a core catcher or other initiating any other downhole operation. The invention comprises a selectively actuatable hydraulic piston coupled to the inner tube. Blockage of a flow-through channel causes a downward longitudinal pressure and force to be exerted against the hydraulic piston. Normally, the hydraulic piston is locked by a locking means to the outer barrel. After sufficient downward force develops against the piston, the locking means releases the hydraulic piston and permits it to travel longitudinally downward within the coring tool. Downward movement of the piston and the inner tube associated therewith is thereafter limited by a mechanical or hydraulic means.

Figure 1:
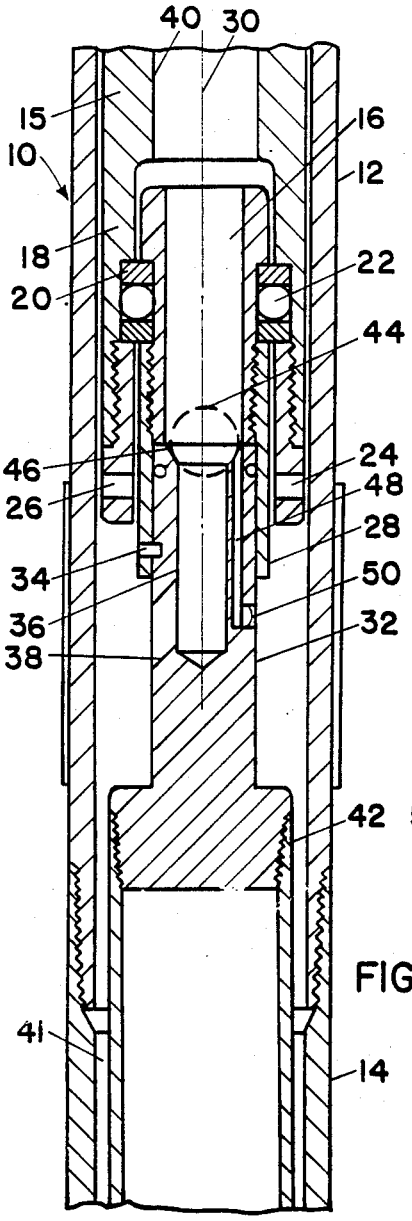
FIG. 1 is a simplified cross-sectional view of a first embodiment of the invention as used to actuate a core catcher.

The invention and its various embodiments are best understood by first turning to the cross-sectional view of a first embodiment illustrated in FIG. 1. Only that portion of drill string 10 connected with the present invention is illustrated. Drill string 10 includes an outer tube sub 12 in which the mechanism is generally contained. Outer sub 12 in turn is conventionally coupled or threaded to outer tube 14 at its lower end and to safety joint box (not shown) at its upper end. A conventional bearing assembly 16 is concentrically disposed within and rotationally and longitudinally fixed with respect to outer tube sub 12. Assembly 16 includes a bearing retainer 18 which is rotatably journalled to bearing assembly 16 by means of conventional ball bearings 22. Ball bearings 22 are disposed within a bearing race 20 defined in corresponding adjacent portions of bearing retainer 18 and cartridge cap 15. A cartridge cap nut 24 is coupled or threaded to cartridge cap 15, and acts as a retaining nut by which ball bearings 22 are maintained within raceway 20.

Thus, bearing retainer 18 is longitudinally fixed with respect to outer tube sub 12 by virtue of its retention by cartridge cap nut 24 while being allowed to rotate with respect to outer tube sub 12. In an actual drilling operation, outer tube sub 12 is of course rotated ultimately by torsion applied to the kelly at the platform surface. Bearing retainer 18 thus remains stationary and allows the inner tube, as described below, to remain rotationally stationary with the cut core.

Cartridge cap nut 24 is threaded onto cartridge cap 16 through the use of tool drive sockets 26 in a conventional manner. Bearing retainer 18 is coupled or threaded to an inner cylindrical sleeve 28. Inner cylindrical sleeve 28 is concentric with the longitudinal axis 30 of drill string 10, and extends downwardly in a concentric telescopic relationship with an inner tube connector or piston 32. Inner tube connector 32 is coupled to sleeve 28 through a shear pin or pins 34, radially disposed through sleeve 28 and into inner tube connector 32. Therefore, inner tube connector 32 is rotationally isolated from outer tube sub 12, and longitudinally fixed through shear pin 34 to bearing retainer 18.

Inner tube connector 32 is characterized by a longitudinal axial flow chamber 36 communicating with at least one bypass port 38 defined through connector 32. The opposing end of chamber 36 freely communicates with the interior annular space 40 within cartridge cap 16, within outer tube sub 12 and within outer tube 14.

Therefore, hydraulic fluid pumped through the drill string flows through chamber 40 in chamber 36, and thence through bypass port 38. The hydraulic fluid continues downwardly within outer tube 14 in an annular space 41 between inner tube 42 on one hand, and outer tube sub 12 and outer tube 14 on the other. Inner tube 42 is coupled or threaded to the lower end of inner tube connector 32. Inner tube 42 continues downwardly within outer tube 14, and is arranged and configured for receiving the core. Inner tube 42 may be coupled to a core catcher or such other mechanisms now known or later devised with which it may be combined in a coring tool. Therefore, inner tube 42 is similarly rotationally isolated from outer tube 14, and longitudinally fixed ultimately through shear pin 34 to outer tube 14.

When it is desired to selectively actuate the invention, a steel ball 44 is dropped into the interior annular space of the drill string, and is carried and falls downwardly with the hydraulic fluid through chamber 40 to ultimately come to rest against an upwardly inclined seat 46 of inner tube connector 32. Ball 44, shown in dotted outline in FIG. 1, when thus seated fully closes the upper end of chamber 36, thereby preventing hydraulic fluid from flowing therethrough. A small, secondary longitudinal duct 48 is defined in inner tube connector 32, and communicates chamber 40 with annular space 41 between inner tube 42 and outer tube 14. Secondary duct 48 is, however, sealed at its lower end by a conventional burst disk 50. Ball 44 and seat 46 are of such a size and design that secondary duct 48 is not sealed or closed by ball 44. Therefore, secondary duct 48 and burst disk 50 in combination serve as a safety relief means to prevent the development of pressures beyond a predetermined magnitude within chamber 40 of the drill string.

Once ball 44 has seated and sealed primary chamber 36, pressure begins to build up behind ball 44 and inner tube connector 32. Ultimately the pressure rises high enough to cause pin or pins 34 to shear at a predetermined shear force. The upper portion of inner tube connector 32 is slidingly disposed within the lower portion of cylindrical sleeve 28, and hydraulically sealed thereto by means of a conventional O ring 52. Once the force is high enough to shear pin 34, inner tube connector 32 begins to act as a piston, and is moved longitudinally downward within cylinder 28, thereby also longitudinally displacing inner tube 42 downwardly.

Therefore, a longitudinal downward force is selectively generated and applied to inner tube connector 32, which can then be used to actuate a core catcher, break a core from a rock formation, or to provide any other required motive force or needed downward movement of inner barrel 42 within coring tool 10.

Downward movement of inner tube connector 32 continues as long as connector 32 remains in a sealed telescopic relationship with cylinder 28. As soon as the burst disc bursts, the hydraulic fluid is then free to flow into annular space 41 as before. The downward longitudinal force or pressure applied to connector 32 is then released. Therefore, by varying the amount of telescopic engagement length between sleeve 28 and connector 32, and the burst disc failure pressure, the downward longitudinal displacement of inner tube 42 can be controlled and limited.

Figure 2:
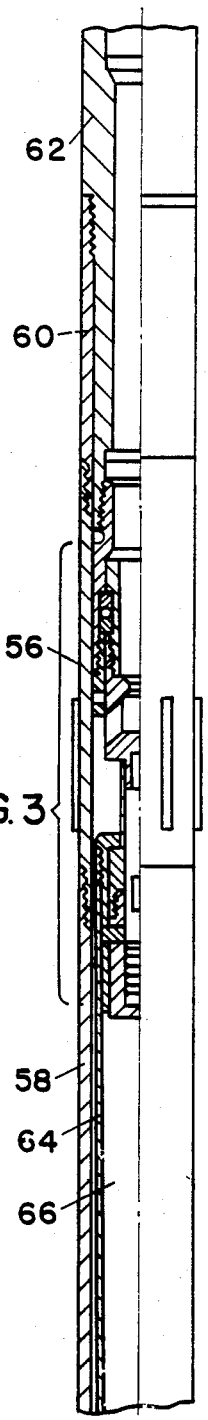
FIG. 2 is a partial cross-sectional view in reduced scale of a coring tool employing a second embodiment of the invention.
Figure 3:
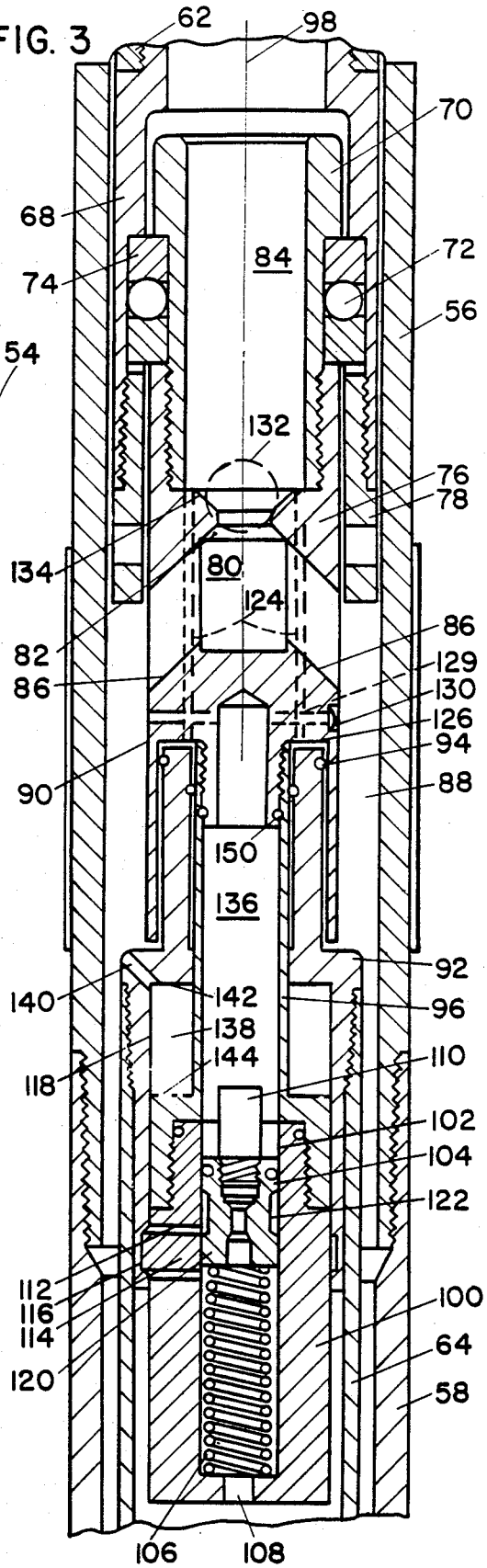
FIG. 3 is an enlarged diagrammatic cross-sectional view of the bracketed portion of FIG. 2.

Turn now to the second embodiment of the invention as best depicted in FIGS. 2 and 3. FIG. 2 shows a partial cross-sectional view of a larger portion of a drill string, 54. In the illustrated portion of drill string 54 a safety joint 62 including a conventional pin and box connection is threadably coupled to outer tube sub 56 which contains the bearing assembly 68 as better described below in connection with FIG. 3. Outer tube sub 56 in turn is threadably coupled to outer tube 58 which extends toward the drill bit (not shown). An inner tube 64 is concentrically disposed in outer tube 58 and defines an axial base 66 in which the cut core is later disposed.

Turn now to FIG. 3, which shows a cross-sectional enlargement of the mechanism of the invention as included within noted area of FIG. 2. As in the embodiment of FIG. 1, a bearing assembly cartridge cap 68 is threadably coupled to sub 62, and ultimately to the upper sections of outer tube 58. A bearing retainer 70 is again concentrically disposed within cartridge cap 68, and is rotationally free or isolated therefrom by means of conventional ball bearings 72. Bearings 72 are disposed in an annular bearing raceway 74 defined in bearing retainer 70. Bearing retainer bottom end 76 is threadably connected to external threading provided on the lower portion of bearing retainer 70. Cartridge cap nut 78 is similarly threadably connected to the threading internally provided on the lower portion of cartridge cap 68. Nut 78 and retainer bottom end 76 serve to secure and maintain retainer 70 and bearings 72 in place.

Bearing retainer bottom end 76 is further characterized by a bypass flow chamber 80. Chamber 80 axially communicates through orifice 82 with an interior annular space 84 in retainer 70 through which the hydraulic fluid is pumped. A plurality of bypass ports 86 are similarly defined through bearing retainer bottom end 76, and communicate with bypass chamber 80, allowing hydraulic fluid to flow from axial chamber 84 through orifice 82 into chamber 80, and thence through ports 86 into an annular space 88 between outer tube sub 56 and outer tube 58 one one hand, and inner tube 64 and the remaining portions of the coring tool on the other.

The lower portion of bearing retainer bottom end 76 is extended to form a cylinder 90. Concentrically and telescopically disposed within cylinder 90 is an outer piston 92. Outer piston 92 is hydraulically sealed to the inner surface of cylinder 90 by means of a conventional O ring seal 94. The lower portion of retainer bottom end 76 is also threadably and axially connected to a top end inner mandrel 96. Inner mandrel 96 forms along its upper portion a hollow cylinder longitudinally aligned with longitudinal axis 98 of the coring tool. The upper portion of outer piston 92 is similarly formed in the shape of a circular cylinder, which, as previously stated, is disposed in a sealed relationship inside cylinder 90 of retainer bottom end 76 on one hand, and on the other hand is concentrically disposed outside of the upper portion of inner mandrel top end 96. A second O-ring seal 150 forms a fluidic seal between the upper portion of inner mandrel 96 and outer piston 92. Piston 92, which is itself a cylinder, is telescopically disposed inside cylinder 90 of retainer bottom end 76 and outside axial inner mandrel 96. Thus, as will be described below, cylinder 90 and inner mandrel 96 are longitudinally fixed within the drill string while outer piston 92 is free to telescopically move in a longitudinally downward direction between them.

The lower portion of outer piston 92 is enlarged to form a cylindrical housing longitudinally extending down the drill string and to which cylindrical housing inner tube 64 is threadably coupled. Within the cylindrical housing provided by the lower portion of outer piston 92 is the axially concentric inner mandrel 96, which itself enlarges to form a smaller cylindrical housing in its lower portion and which is slidably disposed within the cylindrical housing of the lower portion of outer piston 92. A bottom end inner mandrel 100 is then threadably coupled to internal threading inside the cylindrical housing of top end of inner mandrel 96. Bottom end inner mandrel 100 defines an axial bore 102 into which an innerlocking piston 104 is slidingly disposed. Compression coil spring 106, one end of which bears against a perforated blind end 108 of bore 102, and the other end of which bears against innerlocking piston 104, urges innerlocking piston 104 longitudinally upward within bore 102. Further axially disposed within innerlocking piston 104 is a check valve 110, which allows the flow of hydraulic fluid, but only in a longitudinally upward direction through innerlocking piston 104. This allows innerlocking piston 104 to be driven downward and spring 106 to be compressed. Bottom end inner mandrel 100 also includes a radial core 112, into which a locking dog 114 is disposed. Locking dog 114 is arranged and configured to mate with a corresponding indentation 116 defined in the adjacent inner surface 118 of outer piston 92. Normally, the position of radial bore 112, innerlocking piston 104, and locking dog 114 is such that the side of inner locking piston 104 bears against the inward radial surface 120 of locking dog 114, thereby maintaining locking dog 114 in firm engagement with indentation 116 of outer piston 92. However, as will be described below, when innerlocking piston 104 moves longitudinally downward, inner surface 120 of locking dog 114 becomes aligned with a mating indentation 122 defined in innerlocking piston 104. Locking dog 114 is therefore allowed to be forced out of engagement with indentation 116 and into indentation 122, thereby unlocking the temporarily fixed longitudinal coupling between outer piston 92 (and inner tube 64) on one hand, and bottom end inner mandrel 100 (and ultimately outer tube 58) on the other hand.

Return now to consider bearing retainer bottom end 76. Also disposed through retainer 76 are a plurality of secondary ducts 124, which communicate with chamber 84 at one end, and with the annular space or piston chamber 126 defined between outer piston 92 and cylinder 90 of the lower portion of bearing retainer 76. A radial secondary duct 129 communicates with one or more longitudinal secondary ducts 124. Radial ducts 129 are plugged and sealed at least at one end with a conventional burst disk 130, which seals duct 129 from annular space 88. Ducts 129, in combination with burst disk 130 and longitudinal ducts 124, thus provide a means for overpressure protection.

Consider now the operation of the second embodiment as depicted in FIGS. 2 and 3. Turning again specifically to FIG. 3, a steel ball 132, as before, is dropped into the drill string and ultimately comes to rest against seats 134 of bearing retainer bottom end 76. Thus, orifice 82 is completely closed and sealed. Hydraulic pressure building up within chamber 84 is thus transmitted through longitudinal ducts 124 to piston chamber 126. However, outer piston 92 is longitudinally fixed by means of locking dog 114. Radial ducts 129, however, communicate with interior space or innerlocking piston chamber 136 defined by the internal bore of top end inner mandrel 96. Thus, hydraulic fluid is in communication through radial ducts 129 with innerlocking piston chamber 136. Hydraulic pressure thus similarly begins to build up on the top of innerlocking piston 104, and begins to compress coil spring 106. After sufficient pressure has developed, spring 106 will be compressed by a magnitude sufficient to allow locking dog 114 to be forced into mating indentation 122 in innerlocking piston 104, thereby releasing piston 92, which is also being urged downwardly.

As soon as locking dog 114 releases, outer piston 92 begins to move longitudinally downward, and thereby longitudinally displaces inner tube 64 downward as well. The downward movement of outer piston 92 is limited by the length of stroke permitted by the relative longitudinal displacement of outer piston 92 with respect to the lower cylindrical extension of top end inner mandrel 96. FIG. 3 illustrates the apparatus in its locked, unexpanded state. However, as piston 92 is unlocked, it moves downwardly into space 138 defined between the inside of the cylindrical housing defined by the lower portion of outer piston 92 and top end inner mandrel 96. Any fluid trapped within space 138 is bled to annular space 88 through bleed duct 140. Therefore, outer piston 92 is permitted to expand or move downwardly by the full extent of the piston throw until such time as inner surface 142 of outer piston 92 comes into contact with and is stopped by upper surface 144 of the lower cylindrical extension of top end of inner mandrel 96.

It must be understood that many modifications and alterations may be made by those having ordinary skill in the art without departing from the spirit and scope of the invention. The illustrated embodiments have been shown only for the purposes of example, and should not be taken as limiting the invention as defined in the following claims.

We claim:

1. An apparatus for providing downward longitudinal displacement in an inner tube with respect to an outer tube in a coring tool comprising:

a cylinder longitudinally fixed with respect to said outer tube, said cylinder having a bypass port defined therethrough and a plurality of conduits defined through said cylinder communicating with the interior of said outer tube to provide a flow path independent of said bypass port through said cylinder, said bypass port having substantially less flow resistance than said plurality of conduits and therefore preferentially diverting hydraulic fluid from said interior of said outer tube above said cylinder to an annular spaced defined between said cylinder and said outer tube;

a primary piston telescopically disposed within said cylinder and forming a sealed and slideable relationship therewith, said piston connected to said inner tube; and means for selectively closing said bypass port defined in said cylinder to thereby force said hydraulic fluid to flow through said ducts to said interior of said cylinder against said piston in sealed telescopic relationship with said cylinder, whereby said hydraulic force is applied to said cylinder, and said cylinder is longitudinally displaced downwardly with respect to said outer tube.

2. An apparatus in a coring tool for effecting a relative downward, longitudinal displacement of an inner barrel within said coring tool with respect to an outer tube of said coring tool comprising:

a bearing assembly longitudinally fixed with respect to said outer tube and rotationally free with respect thereto;

a cylinder axially disposed within said coring tool and connected to said bearing assembly, said cylinder rotationally free with respect to said outer tube;

a piston telescopically disposed within said cylinder and downwardly longitudinally displaceable with respect thereto;

means for selectively applying a hydraulic force to said piston to longitudinally displace said piston with respect to said cylinder, said inner tube being coupled to said piston, wherein said means for selectively applying said hydraulic force to said piston comprises an integral upper extension of said cylinder connected to said bearing assembly, said upper section of said cylinder defining a bypass port therethrough to divert hydraulic fluid from inside said outer tube away from said piston, a drop ball selectively disposable within said coring tool sized and configured to seal said bypass port, a plurality of ducts defined in said upper section of said cylinder and communicating the interior of said outer tube with the interior of said cylinder and with said piston, whereby hydraulic force is applied to said piston, and whereby said inner tube is selectively longitudinally displaced within said coring tool with respect to said outer tube.

3. An apparatus for effecting downward longitudinal displacement of an inner tube with respect to an outer tube in a coring tool comprising:

a bearing assembly longitudinally fixed with respect to said outer tube and rotationally free therefrom;

a bearing retainer bottom end connected to said bearing assembly, said retainer bottom end having a bypass port defined therethrough, and a cylindrical lower termination, a plurality of ducts defined through said bottom end between said cylinder and the interior of said outer tube to provide a flow path independent of said bypass port, said bypass port having less flow resistance than said ducts and therefore preferentially diverting hydraulic fluid from said interior of said outer tube above said retainer bottom end to an annular space defined between said cylinder and said outer tube;

a primary piston telescopically disposed within said cylinder and forming a sealed and slidable relationship therewith, said piston connected to said inner tube; and means for selectively closing said bypass port defined in said retainer bottom end to thereby force said hydraulic fluid to flow through said ducts to said interior of said cylinder against said piston in sealed telescopic relationship with said cylinder, whereby said hydraulic force is applied to said piston, and said piston is longitudinally displaced with respect to said outer tube.

4. The apparatus of claim 3 further comprising means for selectively locking said piston with respect to said cylinder.

5. The apparatus of claim 4, wherein said means for selectively locking said piston with respect to said cylinder comprises a shear pin disposed at least in part through said piston and adjacent cylinder.

6. The apparatus of claim 4, wherein said means for locking said primary piston with respect to said cylinder comprises an inner mandrel axially extending from said retainer bottom end, a locking dog disposed at least in part within said inner mandrel and radially displaceable within said inner mandrel, said locking dog engageable with said primary piston, and an inner piston telescopically and axially disposed within said inner mandrel, said inner piston biased to assume a first position in contact with said locking dog to urge said locking dog into engagement with said primary piston, thereby locking said primary piston with respect to said cylinder, said plurality of ducts defined in said retainer bottom end communicating with a bore defined in said inner mandrel, said inner piston telescopically disposed within said bore so that hydraulic fluid and force is supplied through said ducts to said inner piston, said inner piston responsively assuming a second position with respect to said locking dog to permit said locking dog to move radially inward out of engagement with said primary piston, thereby selectively freeing said primary piston with respect to said cylinder.

* * * * *